US006257848B1

(12) United States Patent
Terauchi

(10) Patent No.: US 6,257,848 B1
(45) Date of Patent: Jul. 10, 2001

(54) COMPRESSOR HAVING A CONTROL VALVE IN A SUCTION PASSAGE THEREOF

(75) Inventor: Kiyoshi Terauchi, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/377,873

(22) Filed: Aug. 20, 1999

(30) Foreign Application Priority Data

Aug. 24, 1998 (JP) ..... 10-237393
Jun. 1, 1999 (JP) ..... 11-153853

(51) Int. Cl.[7] ..... F04B 23/00; F04B 41/00
(52) U.S. Cl. ..... 417/441; 417/437; 417/307
(58) Field of Search ..... 417/437, 441, 417/446, 447, 295–299, 300, 307–309

(56) References Cited

U.S. PATENT DOCUMENTS

| | | | |
|---|---|---|---|
| Re. 35,672 | 11/1997 | Taguchi | 417/222.2 |
| 4,037,993 | 7/1977 | Roberts | 417/222 |
| 4,480,964 | 11/1984 | Skinner | 417/222 |
| 4,586,874 | 5/1986 | Hiraga et al. | 417/222 |
| 4,606,705 | 8/1986 | Parekh | 417/222 |
| 4,632,640 | 12/1986 | Terauchi | 417/269 |
| 4,664,604 | 5/1987 | Terauchi | 417/222 |
| 4,683,765 | 8/1987 | Miller | 74/60 |
| 4,685,866 | 8/1987 | Takenaka et al. | 417/222 |
| 4,687,419 | 8/1987 | Suzuki et al. | 417/222 |
| 4,688,997 | 8/1987 | Suzuki et al. | 417/222 |
| 4,702,677 | 10/1987 | Takenaka et al. | 417/222 |
| 4,723,891 | 2/1988 | Takenaka et al. | 417/222 |
| 4,729,718 | 3/1988 | Ohta et al. | 417/222 |
| 4,730,986 | 3/1988 | Kayukawa et al. | 417/222 |
| 4,747,753 | 5/1988 | Taguchi | 417/222 |
| 4,752,189 | 6/1988 | Bearint et al. | 417/222 |
| 4,778,348 | 10/1988 | Kikuchi et al. | 417/222 |
| 4,780,059 | 10/1988 | Taguchi | 417/222 |
| 4,780,060 | 10/1988 | Terauchi | 417/222 |
| 4,842,488 | 6/1989 | Terauchi | 417/222 |
| 4,850,810 | 7/1989 | Higuchi et al. | 417/222 |
| 4,865,523 | 9/1989 | Kikuchi et al. | 417/222 |
| 4,874,295 | 10/1989 | Kobayashi et al. | 417/222 |
| 4,878,817 | 11/1989 | Kikuchi et al. | 417/222 |
| 4,882,909 | 11/1989 | Terauchi | 62/209 |
| 4,905,477 | 3/1990 | Takai | 62/196 |
| 4,936,752 | 6/1990 | Terauchi | 417/222 |
| 4,940,393 | 7/1990 | Taguchi | 417/222 |
| 4,960,367 | 10/1990 | Terauchi | 417/222 |
| 5,025,636 | 6/1991 | Terauchi | 62/115 |
| 5,027,612 | 7/1991 | Terauchi | 62/212 |
| 5,039,282 | 8/1991 | Terauchi | 417/222 |
| 5,051,067 | 9/1991 | Terauchi | 417/222 |
| 5,080,561 | 1/1992 | Taguchi | 417/222 |
| 5,092,741 | 3/1992 | Taguchi | 417/222 |
| 5,094,589 | 3/1992 | Terauchi et al. | 417/222 |
| 5,145,326 | 9/1992 | Kimura et al. | 417/222.2 |
| 5,165,863 | 11/1992 | Taguchi | 417/222.2 |

(List continued on next page.)

FOREIGN PATENT DOCUMENTS

| | | |
|---|---|---|
| 3633489A1 | 10/1986 | (DE) . |
| 0219283A2 | 4/1987 | (EP) . |
| 0855506A2 | 7/1988 | (EP) . |
| 0536989A1 | 4/1993 | (EP) . |
| 63-134181 | 9/1988 | (JP) . |

*Primary Examiner*—Teresa Walberg
*Assistant Examiner*—Thor Campbell
(74) *Attorney, Agent, or Firm*—Baker Botts L.L.P.

(57) ABSTRACT

In a compressor for compressing a gaseous fluid, a control valve (22) is arranged for controlling an open area of a suction passage (17,18) which is for introducing the gaseous fluid. In a first state where the gaseous fluid has a relatively low flow rate in the suction passage, the open area of the suction passage is reduced. On the other hand, in a second state where the gaseous fluid has a relatively high flow rate in the suction passage, the open area is increased.

13 Claims, 2 Drawing Sheets

U.S. PATENT DOCUMENTS

| | | | |
|---|---|---|---|
| 5,168,716 | 12/1992 | Terauchi | 62/228 |
| 5,189,886 | 3/1993 | Terauchi | 62/228.5 |
| 5,242,274 | 9/1993 | Inoue | 417/222.2 |
| 5,286,172 | 2/1994 | Taguchi | 417/222.2 |
| 5,318,410 | 6/1994 | Kawamura et al. | 417/222.2 |
| 5,584,670 | 12/1996 | Kawaguchi et al. | 417/222.2 |
| 5,871,337 | 2/1999 | Fukanuma et al. | 417/222.2 |
| 5,873,704 * | 2/1999 | Ota et al. | 417/222.2 |
| 5,873,706 * | 2/1999 | Kawabata | 417/295 |

* cited by examiner

COMPRESSOR HAVING A CONTROL VALVE IN A SUCTION PASSAGE THEREOF

BACKGROUND OF THE INVENTION

The present invention relates to a compressor which is generally used for an air conditioner.

Various types of compressors are used in air conditioners. Among these compressors, particularly, a piston-type variable displacement compressor has an advantage that its displacement or flow rate can be varied. However, since the piston-type variable displacement compressor has a characteristic that the volume of gas passing through a suction valve during the flow rate of the suction valve is low is decreased, the suction valve generates self-excited vibration in its free movement region due to the interaction with the gas passing through the suction valve. The self-excited vibration of the suction valve causes pressure fluctuation of gas i.e. pressure pulsation. Since the compressor is included in a refrigerating cycle together with an evaporator, a condenser, and connecting pipes therebetween, the pressure pulsation is propagated to the evaporator through the connecting pipes from the compressor. As a result, the evaporator is vibrated, thereby producing noise.

Conventionally, to restrain the propagation of pressure pulsation to the evaporator, such a refrigerating cycle is provided with a silencer on the way of the connecting pipes.

However, the way of providing with a silencer has a lot of side issues, such as, making the system expensive, making a space factor worse, and requiring improved vibration proof of the silencer.

SUMMARY OF THE INVENTION

It is therefore an object of the present invention to provide a compressor which can effectively reduce the pulsation in suction pressure due to the self-excited vibration during the flow rate of the suction valve is low, with reducing the danger of causing the side issues.

Other objects of the present invention will become clear as the description proceeds.

According to the present invention, there is provided a compressor for compressing a gaseous fluid. The compressor comprises a suction passage for introducing the gaseous fluid and a control valve which is arranged at the suction passage and is for controlling an open area of the suction passage so that the open area is reduced in a first state where the gaseous fluid has a relatively low flow rate in the auction passage and that the open area being increased in a second state where the gaseous fluid has a relatively high flow rate in the suction passage.

DESCRIPTION OF PREFERRED EMBODIMENTS

Figure 1:
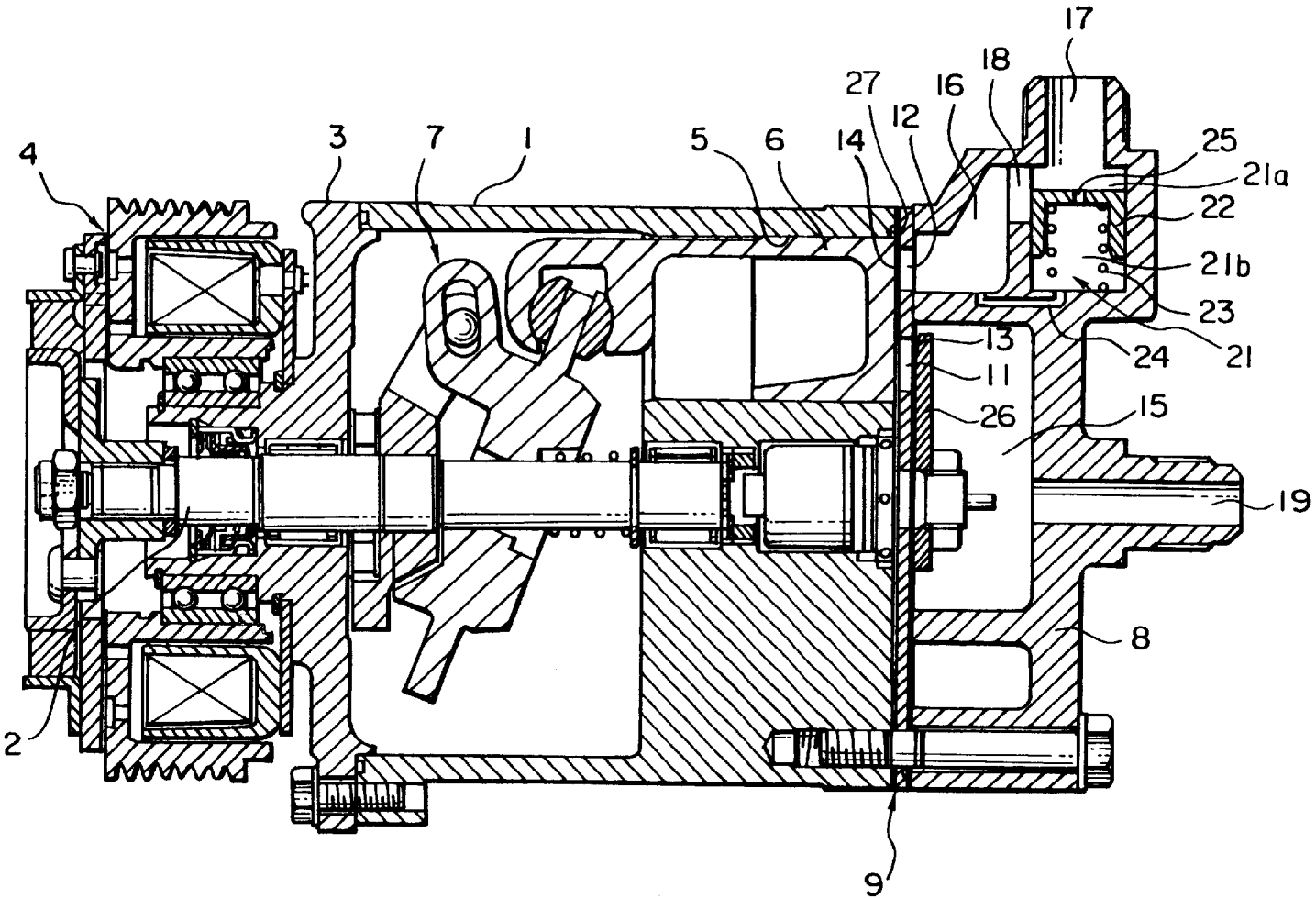
FIG. 1 is a longitudinal sectional view of a compressor according to an embodiment of the present invention.

With reference to FIG. 1, description will be made as regards a compressor according to an embodiment of the present invention. The compressor is a piston-type variable displacement compressor included in a refrigerating system or cycle for a vehicle air conditioner and should be installed in such a manner that its axis eztends horizontally as shown in FIG. 1.

The piston-type variable displacement compressor is for compressing a gaseous fluid or refrigerant gas and comprises a casing 1 and a rotatable main shaft 2 extending in the axial direction at the center of the casing 1. One end of the main shaft 2 is exposed to the outside of the casing 1 after passing through a front housing 3 fixed to one axial and of the casing 1. An outside power source (not shown) is detachably connected to the end of the main shaft 2 via an electromagnetic clutch 4.

An odd number, for example five, of cylinders 5 are formed inside the casing 1 and arranged around the axis. In the cylinders 5, pistons 6 are inserted slidably in the axial direction. These pistons 6 are connected to the main shaft 2 through a crank mechanism 7 which is well known in the art so that the pistons 6 reciprocate inside the cylinders 5 according to the rotation of the main shaft 2. It should be noted that the stroke of the pistons 6 is variable by the work of the crank mechanism 7.

A cylinder head 8 is fixed to the other axial end of the casing 1 via a valve mechanism 9. The valve mechanism 9 comprises discharge valves 13 and suction valves 14 as leaf valves disposed to face discharge holes 11 and inlet holes 12 formed corresponding to the cylinders 5.

Inside the cylinder head 8, discharge and suction chambers 15 and 16 are formed. The discharge chamber 15 is placed at the center of the cylinder head 8. The discharge chamber 15 is connected to the high pressure side of the refrigerating system through a discharge port 19 to supply high pressure gas to a condenser. The suction chamber 16 is placed to extend around the discharge chamber 15. The suction chamber 16 is connected to the low pressure side of the refrigerating system through a suction passage composed of a local passage 18 and an inlet port 17 to receive gas returned from the evaporator.

The inlet port 17 extends upwardly. A valve chamber 21 is formed between the local passage 18 and the inlet port 17. Inside the valve chamber 21, a control valve 22 is placed to be slidable in the vertical direction. As a result, the control valve 22 divides the valve chamber 21 into a first or upper chamber portion 21*a* and a second or lower chamber portion 21*b*. The upper chamber portion 21*a* is connected to the local passage 18 to communicate with the suction chamber 16 through the local passage 18. The lower chamber portion 21*b* is connected to a by-pass passage 24 to comunicate with the suction chamber 16 through the by-pass passage 24.

The control valve 22 has a valve hole 25 formed therein and is biased upwardly by a spring member 23. The control valve 22 controls, by vertically sliding, the open area of the local passage 18, i.e. the open area of the suction passage. That is, the open area of the local passage 18 is maximum when the control valve 22 is at the lowermost position and the open area of the local passage 18 is minimum when the control valve 22 is at the uppermost position. The minimum open area is quite small, not zero.

As the pistons 6 reciprocate inside the respective cylinders 5 according to the rotation of the main shaft 2, refrigerant gas of the suction chamber 16 is sucked into the cylinders 5 through the inlet holes 12 and the suction valves 14 and is also discharged into the discharge chamber 15 through the discharge holes 11 and the discharge valves 13. The discharge valve 13 and the suction valve 14 are prevented by a retainer 26 and stoppers 27 from being excessively deflected.

The refrigerant gas is supplied to the high pressure side of the refrigerating system from the discharge chamber 15 through the discharge holes 19. Since the stroke of the pistons 6 is variable according to the work of the crank mechanism 7, the flow rate is variable between the relatively high flow rate and the relatively low flow rate.

At the relatively high flow rate, the decrease in the pressure of the suction chamber 16 is larger than that in the pressure of the inlet port 17 so that the pressure difference becomes large, thereby developing force of pushing down the control valve 22. Therefore, the control valve 22 moves downward with compressing the spring member 23 so as to widen the open area of the local passage 18. In this case, since the refrigerant gas introduced from the inlet port 17 flows into the suction chamber 16 through the upper chamber portion 21*a* and the local passage 18, the pressure loss is slight. At the high flow rate, the pressure pulsation of the refrigerant gas is small, not contributing noise production.

At the relatively low flow rate, the pressure difference between the suction chamber 16 and the inlet port 17 becomes small so that the control valve 22 is raised by the biasing force of the spring member 23 to reduce the open area of the local passage 18. In this case, the refrigerant gas introduced from the inlet port 17 partially flows into the lower chamber portion 21*b* of the valve chamber 21 through the valve hole 25 and further flows into the suction chamber 16 through the by-pass passage 24. At the relatively low flow rate, the pressure pulsation of the refrigerant gas is increased. However, the pressure pulsation is propagated to the by-pass passage 24 from the suction chamber 16 and further propagated to the inlet port 17 through the lower chamber portion 21*b* and the valve hole 25, thereby weakening the pressure pulsation and rectifying the flow of the refrigerant gas, thus not contributing noise production. At the relatively low flow rate, since large pressure drop is never caused even when the open area is small, no fault is developed due to the throttling.

As mentioned above, by disposing the control valve 22 controlling the open area on the way of the suction passage and throttling the open area during the flow rate is low where the pressure pulsation of the suction valve 14 is largely developed, the pressure pulsation can be reduced because of low pass filter effect given by the throttling and the suction chamber 16. Though refrigerant gas passes through the local passage 18 with a small open area during the flow rate is low, no serious pressure loss is never occurred during the flow rate is low. In this state, even when the suction valve 14 vibrates and the pressure pulsation is developed, the propagation of the pressure fluctuation to the low pressure side of the refrigerating system can be restricted by the volume effect of the suction chamber 16 and the throttling effect of the valve hole 25. On the other hand, as the flow rate is increased, the open area is also increased so that the effect of restricting the pressure pulsation is cancelled. However, since the suction valves 14 move to collide with the stoppers 27 during the flow rate is high, no self-excited vibration is developed. During the flow rate is high, the control valve 22 operates not to disturb the gas flow.

Figure 2:
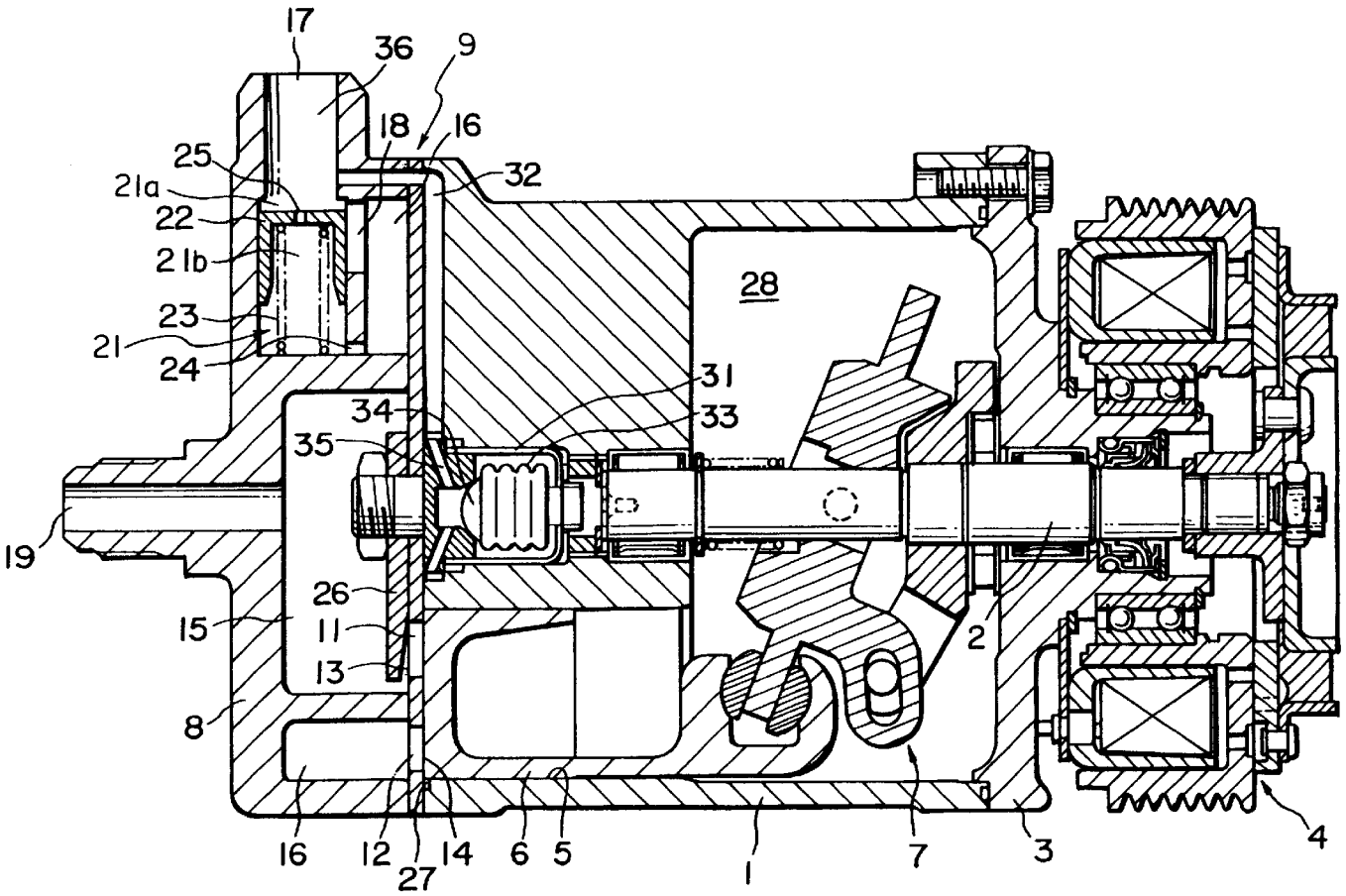
FIG. 2 is a longitudinal sectional view of a compressor according to another embodiment of the present invention.

With reference to FIG. 2, the description will be made as regards a compressor according to another embodiment of the present invention. The compressor is a piston-type variable displacement compressor included in a refrigerating system for a vehicle air conditioner and should be installed in such a manner that its axis extends horizontally as shown in FIG. 2. Similar parts are designated by like reference numerals. The variable displacement compressor has a regulating valve 31 for detecting the inlet pressure and thus regulating the pressure in the crank chamber 28, and a communicating passage 32 for supplying the inlet pressure to the regulating valve 31. The regulating valve 31 is placed between the crank chamber 28 and the communicating passage 32 and comprises bellows 33 and a valve body 34. The bellows 33 expand or contract corresponding to the sensed pressure around them. The valve body 34 opens or closes an outlet 35 according to the expansion or contraction of the bellows 33. The outlet 35 communicates with the suction passage in an upstream portion 36 than the control valve 22 through the communicating passage 32. In this manner, the regulating valve 31 senses the pressure of the upstream portion 36 and controls the pressure of the crank chamber 28.

In the variable displacement compressor, the outlet side of the regulating valve 31 communicates with the suction passage in the upstream portion than the control valve 22. Therefore, the pressure drop by the control valve 22 is cancelled and therefore no problem about fluctuation in the pressure control point by the regulating valve 31.

As described in the above, the present invention enables the pulsation in the suction pressure, caused by the self-excited vibration of the suction valve during the flow rate is low, to be effectively reduced without adding a silencer and deteriorating the capability. Therefore, it can reduce noise from an evaporator during low load operation that is a problem of a piston-type variable displacement compressor.

While the present invention has thus far been described in connection with a few embodiments thereof, it will readily be possible for those skilled in the art to put this invention into practice in various other manners. For example, various structures and configurations may be selected for the control valve in design to obtain the same effect.

What is claimed is:

1. A compressor for compressing a gaseous fluid, comprising:

a suction passage for introducing said gaseous fluid;

a control valve arranged at said suction passage for controlling an open area of said suction passage so that said open area is reduced in a first state where said gaseous fluid has a relatively low flow rate in said suction passage and that said open area being increased in a second state where said gaseous fluid has a relatively high flow rate in said suction passage;

a suction chamber connected to said suction passage for receiving said gaseous fluid from said suction passage, wherein said suction passage comprises a valve chamber, wherein said control valve is movably placed in said valve chamber; and a by-pass passage communicating said valve chamber with said suction chamber.

2. A compressor as claimed in claim 1, wherein said gaseous fluid has pressure difference between said first and said second states in said suction passage, said control valve controls said open area in response to said pressure difference.

3. A compressor as claimed in claim 1, wherein said suction passage further comprises:

a local passage connected to said suction passage; and an inlet port, wherein said inlet port and said local passage are connected to said valve chamber.

4. A compressor as claimed in claim 3, wherein said control valve divides said valve chamber into a first and a second chamber portion which are connected to said local passage and said by-pass passage, respectively.

5. A compressor as claimed in claim 4, wherein said control valve has a valve hole communicating said first chamber portion with said second chamber portion.

6. A compressor as claimed in claim 4, further comprising a spring member for sliding said control valve towards said first chamber portion.

7. A compressor as claimed in claim 3, further comprising:

a crank chamber;

a communicating passage connected to said inlet port; and a regulating valve placed between said crank chamber and said inlet port for controlling pressure of said crank chamber with reference to pressure of said gaseous fluid in said inlet port.

8. A compressor for compressing a gaseous fluid, comprising:

a suction passage for introducing said gaseous fluid;

a control valve arranged at said suction passage for controlling an open area of said suction passage so that said open area is reduced in a first state where said gaseous fluid has a relatively low flow rate in said suction passage and that said open area being increased in a second state where said gaseous fluid has a relatively high flow rate in said suction passage;

a suction chamber connected to said suction passage for receiving said gaseous fluid from said suction passage, wherein said suction passage comprises:

a local passage connected to said suction passage;

an inlet port; and a valve chamber connected to said local passage and said inlet port, said control valve being movably placed in said valve chamber; and a communicating passage connected to said inlet port.

9. A compressor as claimed in claim 8, wherein said gaseous fluid has pressure difference between said first and said second states in said suction passage, said control valve controls said open area in response to said pressure difference.

10. A compressor as claimed in claim 8, further comprising a by-pass passage communicating said valve chamber with said suction chamber said control valve dividing said valve chamber into a first and a second chamber portion which are connected to said local passage and said by-pass passage, respectively.

11. A compressor as claimed in claim 10, wherein said control valve has a valve hole communicating said first chamber portion with said second chamber portion.

12. A compressor as claimed in claim 10, further comprising a spring member for sliding said control valve towards said first chamber portion.

13. A compressor as claimed in claim 8, further comprising:

a crank chamber; and a regulating valve placed between said crank chamber and said inlet port for controlling pressure of said crank chamber with reference to pressure of said gaseous fluid in said inlet port.

* * * * *